US008480824B2

(12) United States Patent
Cola, Jr. et al.

(10) Patent No.: US 8,480,824 B2
(45) Date of Patent: Jul. 9, 2013

(54) METHOD AND APPARATUS FOR MICRO-TREATING IRON-BASED ALLOY, AND THE MATERIAL RESULTING THEREFROM

(75) Inventors: Gary M. Cola, Jr., Washington, MI (US); Jeff W. Ziolkowski, Clinton Township, MI (US); Todd C. Ziolkowski, Romeo, MI (US)

(73) Assignee: SFP Works, LLC, Washington, MI (US)

( * ) Notice: Subject to any disclaimer, the term of this patent is extended or adjusted under 35 U.S.C. 154(b) by 759 days.

(21) Appl. No.: 11/718,969

(22) PCT Filed: Nov. 16, 2005

(86) PCT No.: PCT/US2005/041444

§ 371 (c)(1),
(2), (4) Date: May 9, 2007

(87) PCT Pub. No.: WO2006/055589

PCT Pub. Date: May 26, 2006

(65) Prior Publication Data

US 2007/0261770 A1 Nov. 15, 2007

Related U.S. Application Data

(60) Provisional application No. 60/628,316, filed on Nov. 16, 2004.

(51) Int. Cl.
*C21D 1/62* (2006.01)

(52) U.S. Cl.
USPC ..... 148/612; 148/645

(58) Field of Classification Search
USPC ..... 266/103, 104, 108, 113, 44; 148/612, 148/645
See application file for complete search history.

(56) References Cited

U.S. PATENT DOCUMENTS

| | | | | |
|---|---|---|---|---|
| 3,264,143 | A | 8/1966 | Turner, Jr. | |
| 3,312,576 | A | 4/1967 | Palik | |
| 3,496,033 | A * | 2/1970 | Gilbreath, Jr. et al. | 266/111 |
| 3,556,499 | A | 1/1971 | Hammon | |
| 3,699,797 | A | 10/1972 | Tournoy | |
| 3,964,938 | A | 6/1976 | Tolliver et al. | |
| 4,016,740 | A * | 4/1977 | Gondo et al. | 72/128 |
| 4,321,098 | A | 3/1982 | Hayden | |
| 4,404,047 | A | 9/1983 | Wilks | |
| 4,836,866 | A | 6/1989 | Thuse | |
| 4,872,923 | A | 10/1989 | Borodin | |
| 5,097,585 | A | 3/1992 | Klemm | |

FOREIGN PATENT DOCUMENTS

| | | |
|---|---|---|
| JP | 42-7461 | 2/1967 |
| JP | 45-122821 | 12/1970 |
| JP | 356142815 A | 11/1981 |
| JP | 359094521 A | 5/1984 |
| JP | 63-060100 | 3/1988 |

* cited by examiner

*Primary Examiner* — Scott Kastler

(74) *Attorney, Agent, or Firm* — Cargill & Associates, PLLC; Lynn E. Cargill

(57) ABSTRACT

The invention discloses a process and apparatus for micro-treating an iron-based alloy including heating and immediately quenching to room temperature to produce high tensile iron-based alloy with varying thicknesses. The process may or may not be practiced with or without tension under various controllable tensions in order to create desirable effects The micro-treated iron-based alloy contains desirable bainite to increase its formability and tensile strength. The varying thickness of the iron-based alloys is desirable for different applications, such as forming automobile panels.

33 Claims, 6 Drawing Sheets

METHOD AND APPARATUS FOR MICRO-TREATING IRON-BASED ALLOY, AND THE MATERIAL RESULTING THEREFROM

CROSS REFERENCES TO RELATED APPLICATIONS

This application claims the benefit of U.S. Provisional Application No. 60/628,316 filed on Nov. 16, 2004, which is incorporated herein by reference.

TECHNICAL FIELD

This invention relates to treated iron-based alloys, and more particularly relates to a process and an apparatus for making the same and the material resulting therefrom which transforms low carbon steel and other iron-based alloys to bainite and/or martensite by micro-tempering or micro-treating the low carbon alloy.

BACKGROUND OF THE INVENTION

It has long been a goal of metallurgists to take low grade metals, such as low carbon steel, and turn them into high quality steels and more desirable products through inexpensive treatments, including annealing, quenching, and tempering to name a few. Previous attempts have met with limited success in that they did not always produce a desirable product.

It is a goal and an advantageous aspect of the present invention to provide an inexpensive, quick and easy way to produce a low carbon iron-based alloy containing bainite and/or martensite.

Processing of steel generally takes large pieces of equipment, expensive and dangerous heated fluids, such as quenching oils and quenching salts, and tempering processes which include the use of ovens and residual heat from pouring molten steel followed by quenching in order to raise the hardness of the steel to a desirable value. Bainite and martensite are very desirable materials, and they generally have Rockwell hardnesses of from about 40 and up.

Bainite is generally an acicular steel structured of a combination of ferrite and carbides that exhibits considerable toughness while combining high strength with high ductility. Usually formed by austempering, bainite is a very desirable product. The practical advantage of bainitic steels is that relatively high strength levels together with adequate ductility can be obtained without further heat treatment, after the bainite reaction has taken place. The steels are readily weldable, because bainite, rather than martensite, will form in the heat-affected zone adjacent to the weld metal, so the incidence of cracking will be reduced. Furthermore, the steels have a low carbon content, which improves the weldability and reduces stresses arising from transformation.

Martensite is another acicular steel made of a hard, supersaturated solid solution of carbon in a body-centered tetragonal lattice of iron. It is generally a metastable transitional structure formed during a phase transformation called a martensitic transformation or shear transformation in which austenized steel is quenched to a temperature just above the martensite range and held at that temperature to an equalized temperature throughout before cooling to room temperature. Since chemical processes accelerate at higher temperature, martensite is easily destroyed by the application of heat. In some alloys, this effect is reduced by adding elements such as tungsten that interfere with cementite nucleation, but, more often than not, the phenomenon is exploited instead. Since quenching can be difficult to control, most steels are quenched to produce an overabundance of martensite, and then tempered to gradually reduce its concentration until the right structure for the intended application is achieved. Too much martensite leaves steel brittle, too little leaves it soft.

Therefore, it is an aspect of the present invention to provide a method and apparatus for micro-treating low carbon iron-based alloys to contain a desirable quantity of bainite and/or martensite. The micro-treated low carbon iron-based alloy may have varying thicknesses for application and be readily weldable while having the high tensile strength, the ability to save material and to reduce weight.

It is a goal and an advantageous aspect of the present invention to provide an inexpensive, quick and easy way to produce a low carbon iron-based alloy containing bainite and/or martensite.

SUMMARY OF THE INVENTION

In accordance with the present invention, there is provided a method and apparatus for micro-treating low carbon iron-based alloys to have varying thicknesses and to contain a desirable quantity of bainite or martensite.

A method for micro-treating an iron-based alloy includes providing an elongated piece of carbon iron-based alloy having a first micro-structure and a first thickness, the iron-based alloy along a path of motion through a first tensioning unit at a first feed rate; heating the iron-based alloy under tension; quenching immediately the iron-based alloy in an adjacent quenching unit to room temperature; and drawing the iron-based alloy by a second tensioning unit at various draw rates, some preferably higher than the feed rate to transform the iron-based alloy into a second micro-structure potentially with a second thickness different from the first thickness. Repeating a step of adjusting the speed of the feed and draw rates at the first or the second tensioning units will result in varying thicknesses of the iron carbon alloy.

Apparatus for micro-treating a low carbon iron-based alloy, preferably a low carbon steel strip, includes at least a heating unit for heating the iron-based alloy; a quenching unit positioned adjacent the heating unit for rapidly quenching the heated iron-based alloy, to room temperature; spaced first and second tensioning units positioned on opposite sides of the heating and quenching unit for moving the iron-based alloy through the heating and quenching unit, preferably under tension; and a control unit for controlling and adjusting the feed rate of the first tension unit, the draw rate of the second tension unit, the heating rate of the heating unit and the cooling rate of the cooling unit. An optional heat resistant insulator may be located between the heating unit and quenching unit to insulate the heating unit from the quenching unit and to straighten the moving strip steel An advantage of the invention is that a low carbon iron-based alloy, potentially with varying desired thicknesses may be treated quickly and inexpensively to yield a high quantity of bainite and/or martensite that will be ready to be utilized without further formations or treatments.

Another advantage of the invention is that it uses a highly concentrated heating unit using a highly combustible gas, such as a propane or oxygen heating, so that high temperature flames may be blasted against an iron-based alloy surface to about 2500° F. in a relatively short period of time. The heating unit alleviates the need for increased fuel costs to fire up a big furnace, as the heating is so localized.

A further advantage of the invention is that it uses a hard quench, so that quench cracking and workpiece distortion is alleviated.

BRIEF DESCRIPTION OF THE DRAWINGS

For a further understanding of the nature and advantages of the expected scope and varying embodiments of the present invention, reference shall be made to the following detailed description, and when taken in conjunction with the accompanying drawings, in which like parts are given the same reference numerals, and wherein.

DETAILED DESCRIPTION OF THE INVENTION

In accordance with the present invention, there is provided a new method for micro-processing iron-based alloys, including low carbon steel, to yield hardened materials that are desirable for many applications. In the present invention, iron-based alloy may be stretched to a varying thickness between two sets of tensioning units and heated to a suitable temperature above 1,900° F. and thereafter immediately quenched to room temperature with a quench means adjacent to the heat source in order to form bainitic and/or martensitic structural compounds. The process of micro-treating a iron-based alloy includes providing an iron-based alloy, feeding continuously the iron-based alloy along a path of motion to a first tensioning unit, heating the iron-based alloy to a high temperature, quenching the heated iron-based alloy immediately thereafter, and drawing the iron-based alloy by a second tensioning unit to form at least portions of the alloy into bainite and/or martensite. By adjusting the draw rate of the second tensioning unit, the processed iron-based alloy may be stretched at any desired interval to form continuous pieces of steel with a varying thickness, ready to be stamped and most advantageously for manufacturing articles such as automotive body panels, contains a desirable quantity of bainite or martensite and has a varying thickness readily for applications.

Although the embodiments below illustrate the micro-treating process and apparatus of the present invention for a strip of low carbon iron-based alloy; it is also feasible to utilize the present invention on wire, sheet, hollow tubes, which can be used for flag poles, and bar stock as well. A preferred iron-based alloy may contain carbon in the range of from about 0.001 percent carbon by weight (wt %) to about 4 percent carbon by weight (wt %). A more preferred iron-based alloy may contain carbon in the range of 0.003 percent carbon by weight (wt %) to 2 percent carbon by weight (wt %) while the carbon content is most preferably from about 0.1 wt % to about 0.7 wt %.

Figure 1:
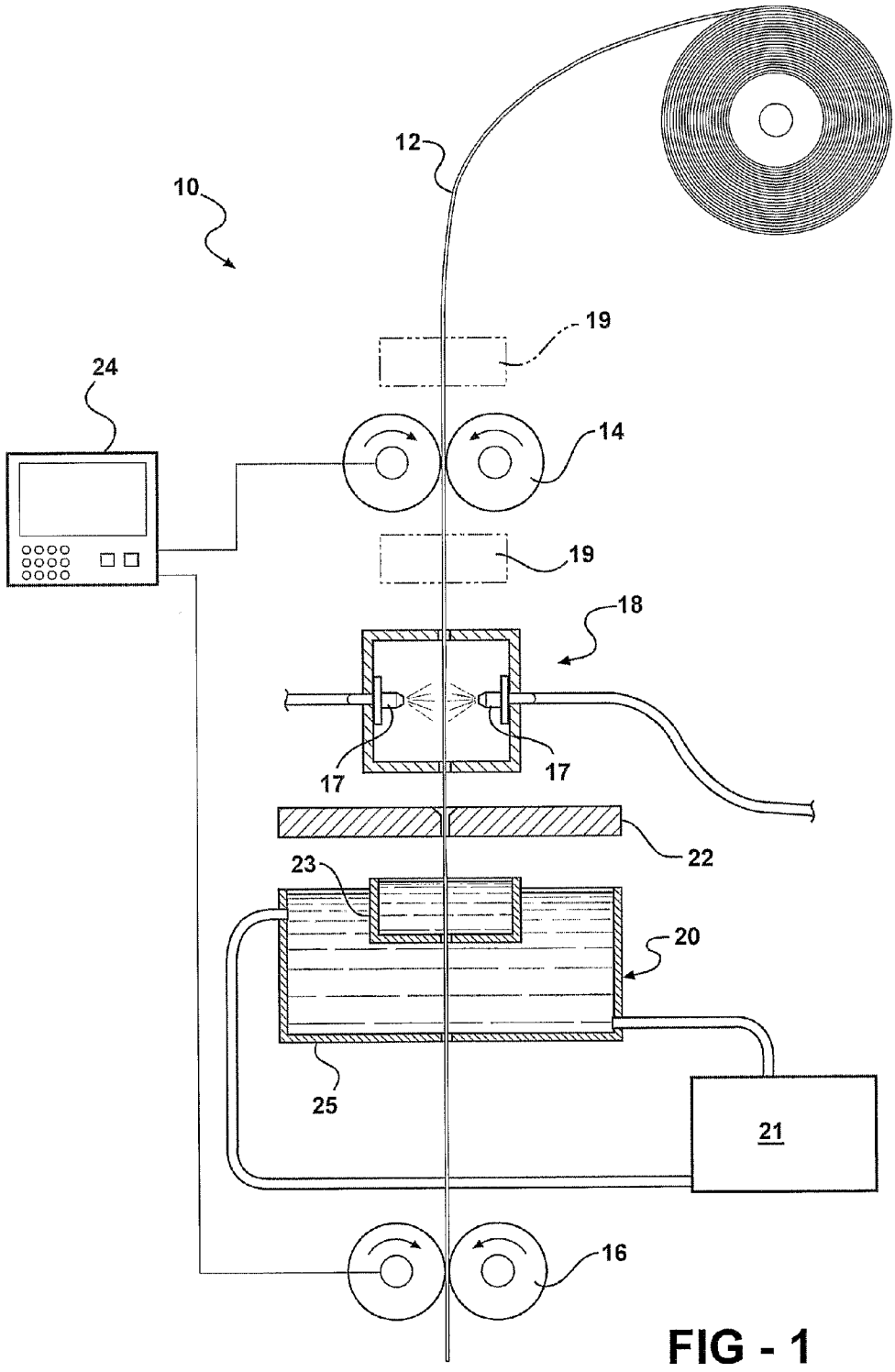
FIG. 1 is a side elevational view of an apparatus for processing a low carbon iron-based alloy in accordance with the present invention.

To better explain the process and apparatus of the present invention, we look first to FIG. 1 in which the micro-processing equipment is generally denoted by an assembly 10. Although large production rolls of iron-based alloy may be processed in accordance with the present invention, we will generally discuss a smaller roll application here. So in this embodiment, a rolled up strip of iron-based alloy is shown as 12, and is about 3 to 5 inches wide and from about 1 mm (0.0393 inch) to 2 mm (0.0787 inch) thick, and it is shown as being drawn through first and second tensioning units 14 and 16 in order to tension the iron-based alloy 12 as it is being processed. The first tensioning unit 14 feeds the steel strip at a feed rate of from about 7.00 IPM (inches per minute) to about 15.00 IPM. The first and second tensioning units 14 and 16 may be any suitable device providing tension on the moving iron-based alloy 12, such as drawing rollers, drive capstans, and elongation drives.

A primary heating unit 18 forms a heating zone of about 4 to 6 inches in length, of about ½ inch to 2 inches in width and of about 1 to 2 inches in depth. The primary heating unit 18 heats the strip of the iron-based alloy 12 by blasting a series of pinpoint high temperature flames against the surface of the strip of iron-based alloy 12 to heat the strip nearly instantaneously to a preferred temperature above 2,200° F. A secondary heating unit 19 may optionally pre-heat the iron-based alloy 12 to a temperature in the range of about 1,400° F. to 1,800° F. before it enters into the heating zone of the primary heating unit 18. As the iron-based alloy 12 may optionally be pre-heated, the secondary heating unit 19 may be placed in any suitable location, such as adjacent to the first tensioning unit 14 or between the first tensioning unit 14 and the primary heating unit 18.

Immediately thereafter, a quenching unit 20, which may preferably be a source of cooling water from about 32° F. to about 150° F., is directed at the strip of iron-based alloy 12 in a linear configuration to immediately cool the heated iron-based alloy to room temperature. The quenching unit 20 may preferably include a water bucket 23 to cool the iron-based alloy 12 to room temperature, a water holding reservoir 25 to collect additional water from the water bucket 23 and a chiller 21 connected to the water bucket 23 to keep the water bucket 23 at a suitable quenching temperature. Although the quenching medium here is water, any other suitable quenching fluid may be used, including, but not limited to, oils, salts, organic liquids and other inorganic fluids.

After immediate quenching, the second tensioning unit 16 draws the strip of alloy at a draw rate of from about 15.00 IPM to about 20.00 IPM. The suitable distance between the primary heating unit 18 and the quenching unit 20 depends on the feed rate of the first tensioning unit 14 and the draw rate of the second tensioning unit 16, which as a whole is a determining factor in the varying thickness of the resulting material.

For vertical applications, we have found it most helpful to further incorporate a heat resistant insulator 22 located between the primary heating unit 18 and quenching unit 20, thereby insulating the primary heating unit 18 from the quenching unit 20 and straightening the moving strip of iron-based alloy 12 while it is being heated and quenched. The heat resistant insulator 22 may be made of any suitable heat resistant material such as ceramic or woven Kevlar sheets. A ceramic plate wrapped with a woven carbon sheet is preferable in the present invention. This heat resistant insulator is preferably in a configuration that allows for performance of the micro-treatment on varying thicknesses, i.e. the slit width shall not be a fixed value. Woven carbon sheets are flexible enough to accommodate the varying thicknesses.

A computer operated control unit 24 controls and adjusts the feed rate of the first tension unit 14, the draw rate of the second tension unit 16, the heating rate of the primary heating unit 18 and the cooling rate of the cooling unit 20. Therefore, the low carbon iron-based alloy 12 may have a varying thickness by having different tension applied thereon via the operation of the control unit 24. Preferably, the resulting iron-based alloy has a thickness of from about 0.049 to about 0.54 inch. In addition, experimental results show that the resulting material of the iron-based alloy was converted into a high quantity of bainite or martensite.

Figure 2:
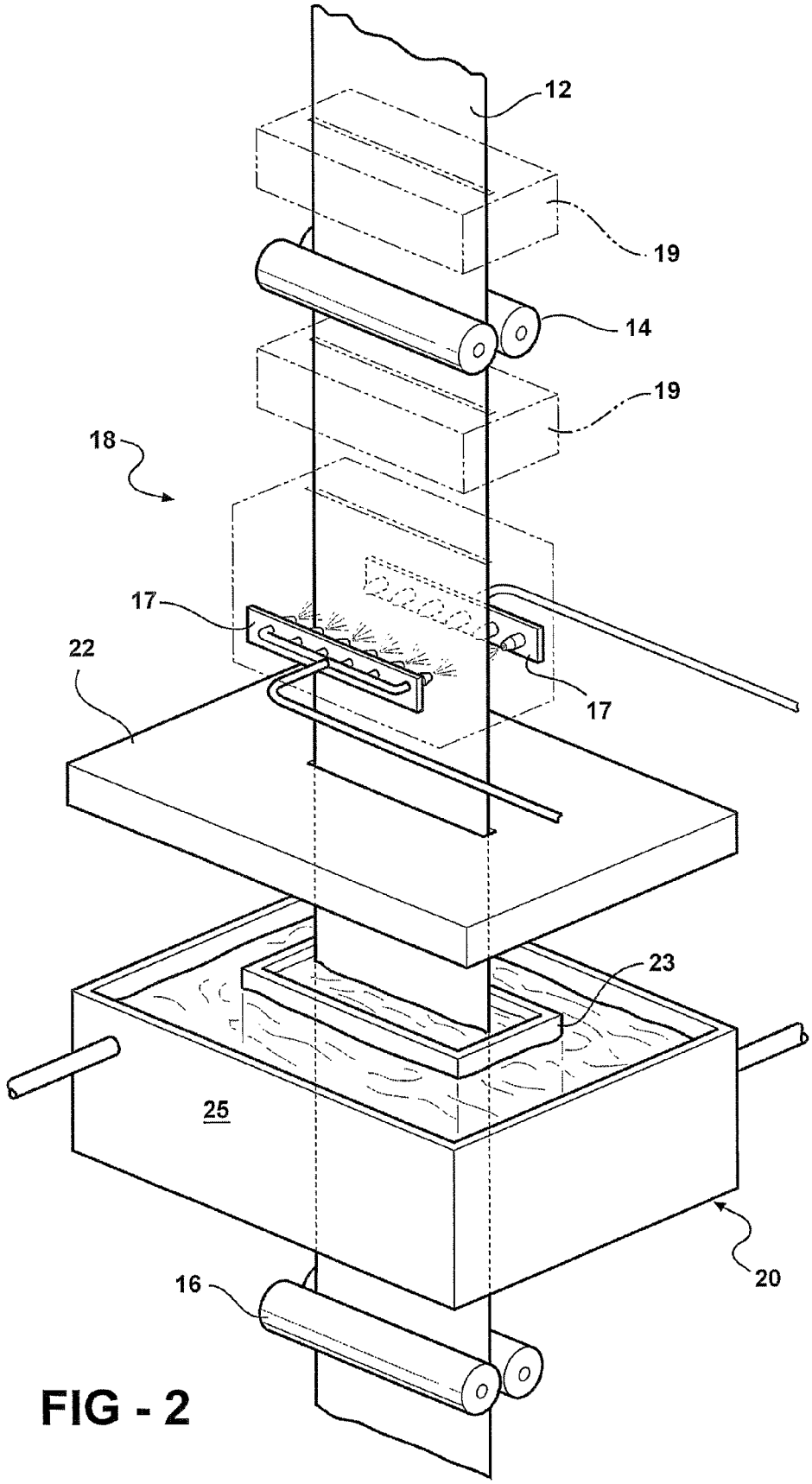
FIG. 2 shows an exploded perspective side view of a section between two tensioning units of FIG. 1.

The primary or secondary heating unit may be any suitable heating means such as electric resistance heaters, fluidized beds, electric furnaces, plasma furnaces, microwave ovens, open environment propane forges, gas fired means, solid fuels, and torches. The heating unit may transfer heat by various ways such as radiation, conduction, convection, and induction. As far as this application, the preferred heating unit may be propane torches. Propane torches may include blaster nozzles 17 and a valve control (not shown) operably connected to the blaster nozzles 17 for effecting heating control, as shown in FIG. 1 and FIG. 2. Propane torches of a miniature dimension have proven to be extremely helpful in raising the temperature of steel from room temperature up to about 1,832° F. and further to 5,072° F. (about 1,000° C. to 2,800° C.) in a controllable manner. The torches are very useful for the rapid heating of the iron-based alloy, although the above-mentioned methods are equally capable of accomplishing the same task. It must be understood that the heating of the iron-based alloy may be accomplished in any of a number of ways, although the propane torch heaters suffice for the desired effect.

Further, the quenching can be accomplished in many ways, including quenching by the use of contacting with water, water-containing aqueous solutions, oil, molten salt, brine solutions, air, and powders of varying materials. The quenching operation occurs very close to the heating operation, i.e. within a matter of fractions of one inch up to several feet downstream from the propane heaters. The quenching unit should preferably be located in close and adjacent proximity to the heating, in order to control the resulting temperature of the iron-based alloy. This proximity is believed to achieve the "micro-treating" advantage of the present invention. During the heating and cooling steps, the iron-based alloy may be merely fed through, or it may remain under tension, thereby elongating during the heating, and then freezing into that elongated dimension when it is quenched. The above-mentioned quenching mediums may be selected for the particular material being micro-treated. In the following examples, the quenching unit utilized is tap water, which is directed onto the opposite surface of the iron-based alloy.

To best achieve its full hardening potential, it is best to use a hard quench, so that quench cracking and workpiece distortion are alleviated. The disadvantages of furnace heating are eliminated because there is not enough time for embrittled elements to get to the grain boundaries of the steel and therefore cause cracking. Tempering may or may not be needed to achieve the full potential of the present invention.

The following examples, while illustrative, will not limit the invention, but rather are given here to explain certain parameters utilized. The chemistry data (wt %) of the carbon steels used as examples are as follows:

TABLE 1

| Chemistry Data | 1018 carbon steel | 1019 carbon steel | 1020 carbon steel | 1008 carbon steel |
|---|---|---|---|---|
| Carbon | 0.14-0.2 | 0.15-0.2 | 0.17-0.23 | 0.1 max |
| Iron | Balance | Balance | Balance | Balance |
| Manganese | 0.6-0.9 | 0.7-1 | 0.3-0.6 | 0.3-0.5 |
| Phosphorus | 0.04 max | 0.04 max | 0.04 max | 0.04 max |
| Sulphur | 0.05 max | 0.05 max | 0.05 max | 0.05 max |

TABLE 2

| Chemistry Data | 8620 carbon steel |
|---|---|
| Carbon | 0.18-0.23 |
| Chromium | 0.4-0.6 |
| Manganese | 0.7-0.9 |
| Molybdenum | 0.15-0.25 |
| Nickel | 0.4-0.7 |
| Phosphorus | 0.035 max |
| Silicon | 0.15-0.35 |
| Carbon | 0.18-0.23 |

EXAMPLE 1

A strip of 1018-1020 low carbon steel of 0.064 inch thick by 3.02 inches wide was stretched under tension between two securement points in first and second tensioning units with a feed rate of 10.75 IPM (inches per minute) and a draw rate of 13.25 IPM. Between the securement points a primary heating unit blasted two sets of pinpoint high temperature flames, each about ½ inch in diameter towards the opposing faces of the steel strip to heat the steel to 1,900° F. As the steel moved and stretched downward through the first tensioning unit, a quenching unit bucket directed a cold water stream onto the heated steel strip under tension about ½ inch lower than the flame to cool the steel strip to about 57° F., yielding a steel that tested to be 30 Rc.

EXAMPLE 2

A strip of 8620 low carbon steel of 0.062 inch thick by about 3.00 inches wide was stretched between two securement points in a first and a second tensioning unit with a feed rate of about 10.75 IPM and a draw rate of about 13.25 IPM. Between the securement points a heating unit blasted two opposing sets of multiple pinpoint high temperature flames about ⅛ inch tall by 3 inches wide towards the opposing faces of the steel strip to heat the steel to about 2,350° F. As the steel moved and stretched downward through the first tensioning unit, a quenching unit directed a cold water stream onto the heated steel strip under tension about ¾ inch lower than the flames to cool the steel strip to about 70° F. within seconds, yielding a steel that tested to be 48 Rc. This material is found to have a micro-structural content that is 85 percent (85%) of bainite. The resulting thickness is controllably reduced from 0.062 inch to a range of 0.049 inch to 0.054 inch.

EXAMPLE 3

A strip of 1008 low carbon steel (about 0.036 percent carbon by weight) of 0.065 inch thick by 3.02 inches wide was stretched between two securement points in a first and a second tensioning units with a feed rate of about 10.75 IPM and a draw rate of from about 10.75 IPM to about 16 IPM. Between the securement points, a heating unit blasted two opposing sets of multiple pinpoint high temperature flames about ⅛ inch tall by about 3 inches wide towards the opposing faces of the steel strip to heat the steel to 2,250° F. As the steel moved and stretched downwards through the first tensioning unit, a quenching unit directed a cold water stream onto the heated steel strip under tension about ½ inch to 1 inch lower than the flame to cool the steel strip to about 70° F. within seconds, yielding a steel that tested to be from 1 to 36 Rc. This material is found to have a microstructure content that is mostly martensite. The resulting thickness is controllably reduced from 0.065 inch to a range of 0.046 inch to just less than 0.065 inch. A low carbon steel, such as steel 1008, can be taken from 1 Rc to 36 Rc, which equates to a tensile strength of up to 161 KSI.

Figure 3:
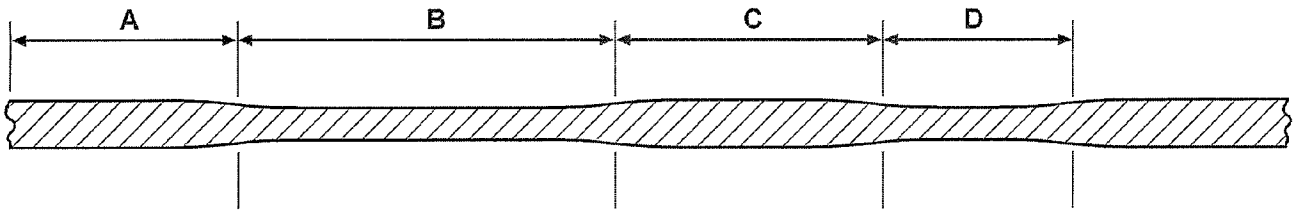
FIG. 3 shows a side view of varying thicknesses of a low carbon iron-based alloy processed in accordance with the present invention.

FIG. 3 shows a side view of varying thicknesses at the various sections of an iron-based alloy, such as low carbon steel, processed in accordance with the present invention. At section A, the thickness of the iron-based alloy is the same as an initial thickness. At section B, two tensioning units reduce the thickness of the iron-based alloy from the initial, first thickness to a second thickness. At section C, the iron-based alloy is processed from the second thickness back to the first thickness. At section D, the iron-based alloy is reduced again by two tensioning units from the first thickness to the second thickness. The diagram can go on and on to repeat the cycle of the first thickness and the second-thickness. However, in addition to the second thickness, there may be a third or a fourth thickness, if the processor desires his alloy to have for different sections upon completion of all operations.

The preferred first thickness may be in the range of 0.009 to 0.250 inch and the preferred second thickness may be in the range of 0.003 to 0.200 inch. The most preferred first thickness may be in the range of 0.060 to 0.125 inch and the most preferred second thickness may be in the range of 0.030 to 0.080 inch.

Figure 4:
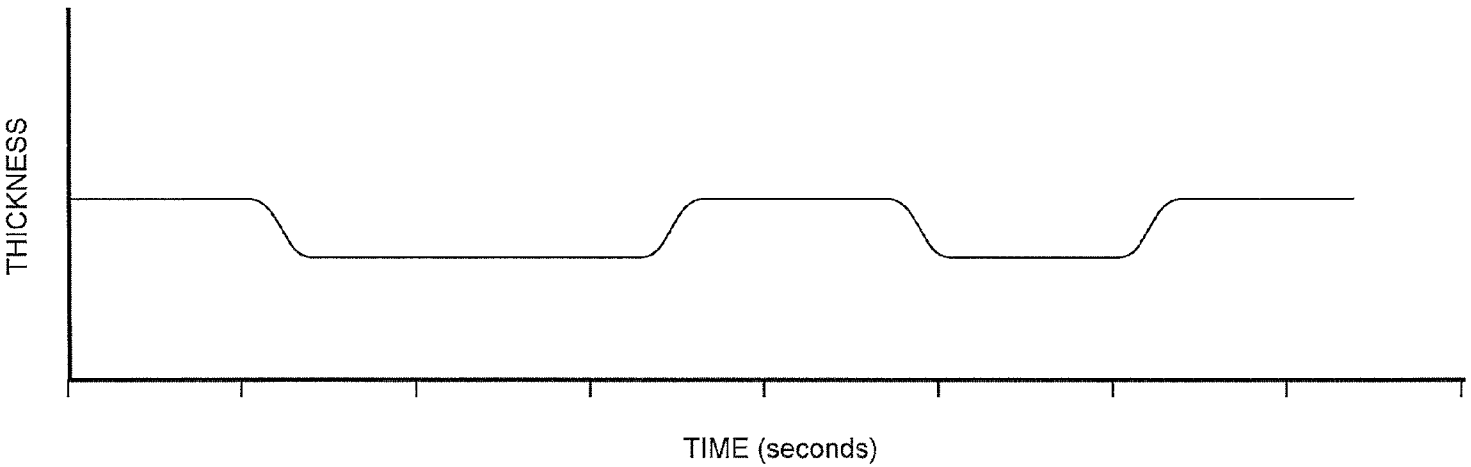
FIG. 4 is a thickness vs. time diagram illustrating the varying thickness sections of the low carbon iron-based alloy; processed in accordance with the present invention.

FIG. 4 is a thickness vs. time diagram illustrating the varying thickness sections of the low carbon iron-based alloy processed in accordance with the present invention. During the micro-treating process, adjusting the feed rate and draw rate of the tensioning units results in a varying thickness of the resulting alloy, as the one shown in FIG. 3. This ability to vacillate between varying thicknesses provides us with the ability to form rolls of steel suitable to make continuous stamping pre-forms. Each pre-form can be stamped off the steel roll, and certain parts may be essentially "reinforced" at the thicker portions that are easier to stamp out because those locations are thinner. This capability means that secondary steel plates may no longer be needed to be welded together for the hinge securement areas of automotive door panels as a reinforcement.

Figure 5:
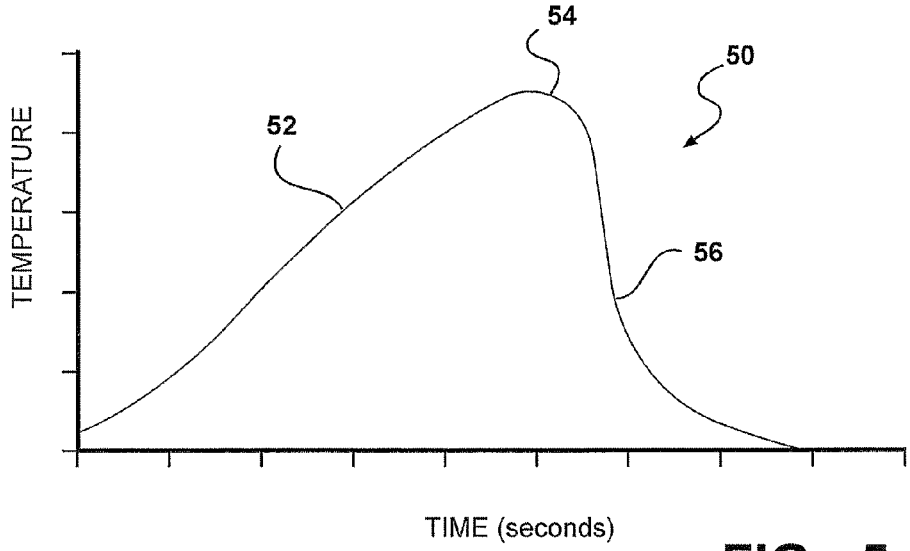
FIG. 5 is a temperature vs. time diagram illustrating the change of temperature during the heating and quenching steps for processing a specimen of iron-based alloy; processed in accordance with the present invention.

FIG. 5 is a temperature vs. time diagram illustrating the relative change of temperature during the heating and quenching steps for processing a specimen of iron-based alloy. For illustrative purposes, the iron-based alloy is heated to follow a temperature gradient curve, generally indicated by numeral 50, in which the temperature is increased on the positively sloped side 52 of the curve, and reduced on the negatively sloped side 56 of the curve. Curve 52 represents the desired temperature gradient of the iron-based alloy moving through the heating unit. The maximum temperature is at point 54 which is above the eutectoid temperature of the material. The iron-based alloy is quenched according to side 56 of the curve.

Figure 6:
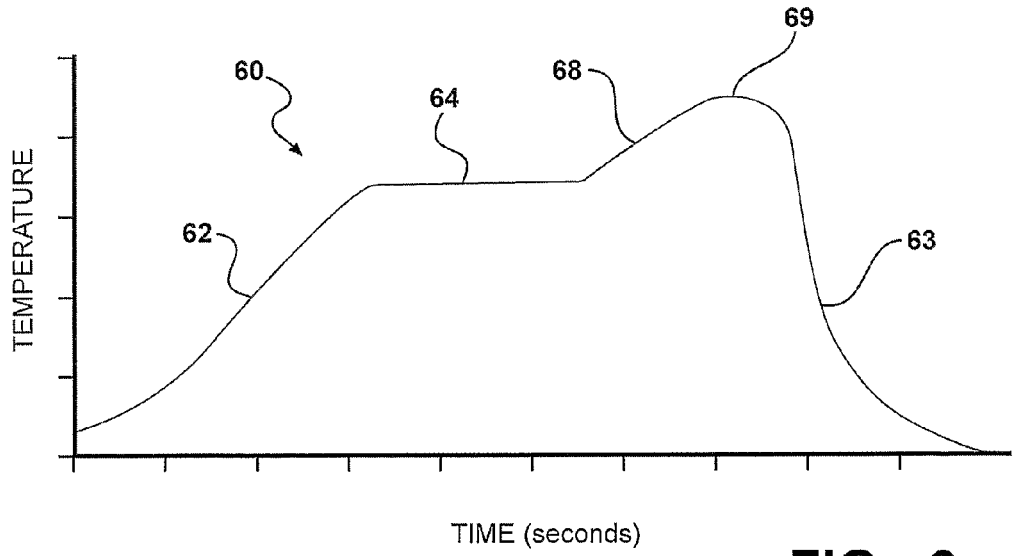
FIG. 6 is a temperature vs. time diagram illustrating the change of temperature during various optional pre-heating, heating and quenching steps for processing a specimen of iron-based alloy.

FIG. 6 is a temperature vs. time diagram illustrating the change of temperature during another embodiment of the present inventions illustrating the pre-heating, heating and quenching steps for processing a specimen of iron-based alloy. For illustrative purposes, the iron-based alloy is heated to follow a temperature gradient curve, generally indicated by numeral 60, in which the temperature is increased on the positively sloped side of the curve, including sections 62, 64 and 68, and reduced on the negatively sloped side 63 of the curve. As the iron-based alloy passes through a secondary heating unit to pre-heat, the temperature increases to a level below the austenitic forming temperature as shown by section 62. The iron-based alloy is then maintained at a plateau 64 for a short period of time before entering the primary heating unit. When the iron-based alloy goes through the primary heating unit, the temperature increases, as shown by section 68, to a level above the austenitic forming temperature, which is at point 69. Immediately, the iron-based alloy then enters the quenching unit where its temperature is rapidly reduced to room temperature, as shown by section 63.

Iron-based alloy that may be transformed may include any cross section, including strips and/or sheets of steel, angle iron, hollow tubes, the outer skin of an automobile door, laser welded blanks for use on the inside of automobile doors, I-beam configurations, and fractional portions of the blanks. In addition, steel planks may achieve patterns of bainite, mailensite, or combinations thereof in any pattern across the surface of the plank or sheet.

Figure 7:
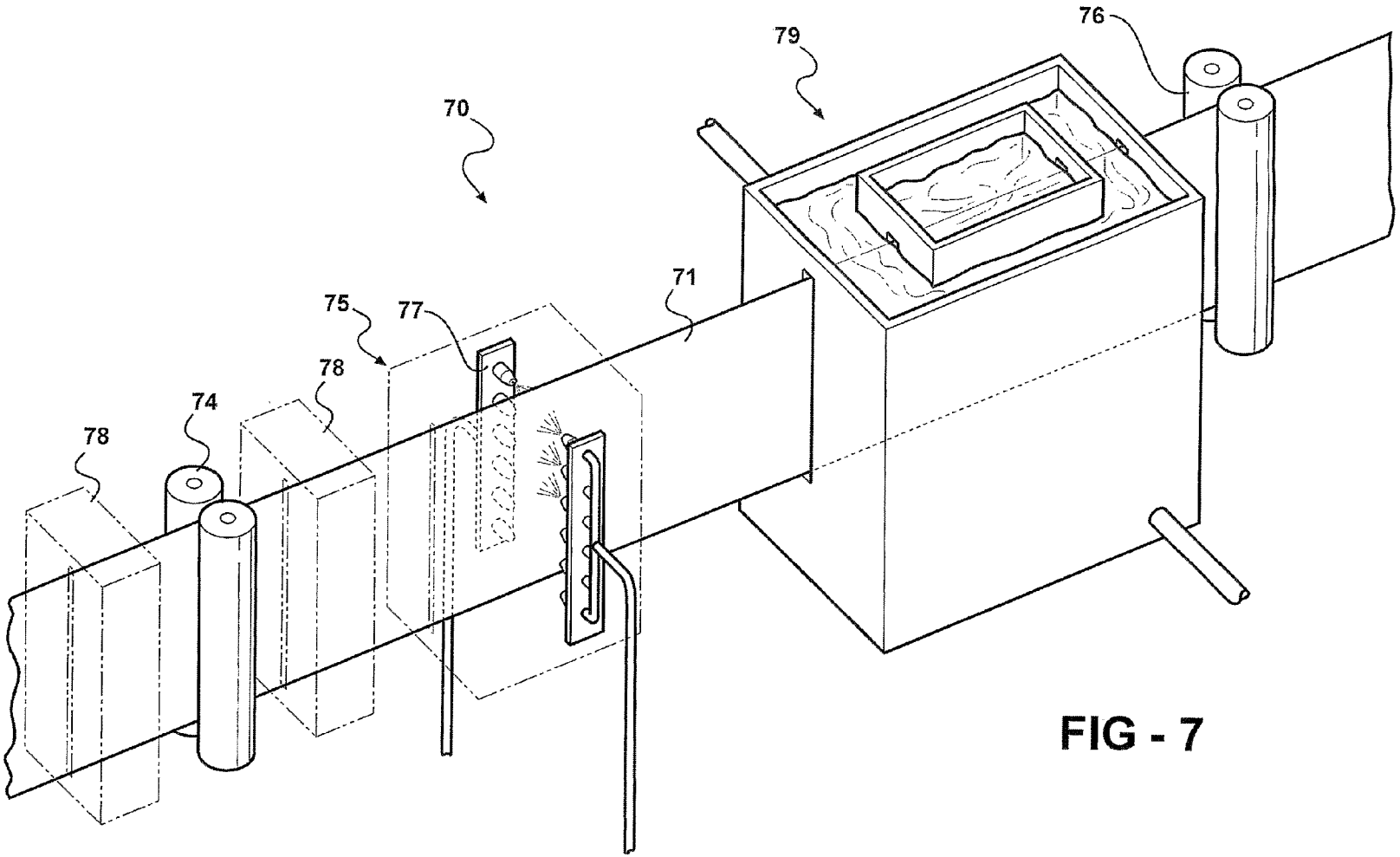
FIG. 7 shows a perspective view of a high production volume apparatus for processing a roll of low carbon steel to be used to form an automobile panel in accordance with the present invention.

FIG. 7 shows a perspective view of the apparatus, generally denoted by an assembly 70, for processing a sheet of low carbon steel 71 to form an automobile panel in accordance with the present invention. The process of micro-treating a steel sheet is similar to the process of micro-treating an iron-based alloy as described above.

In this embodiment, the sheet of low carbon steel 71 is drawn under tension through a first and a second tensioning unit 74 and 76, respectively, as it is being processed. The first and second tensioning units 74 and 76 may be any suitable devices providing tension on the moving iron-based alloy 12, such as drawing rollers, drive capstans, and elongation drives.

As before, a primary heating unit 75 heats the sheet of steel 71 by blasting a opposing set of multiple pinpoint high temperature flames against the surface of a sheet of steel 71 to above 2,200° F. A preferred heating unit utilizes propane torches. The propane torches may further include blaster nozzles 77 and a valve control (not shown) operably connected to the blaster nozzles 77 for effecting heating control. The partial heating step may be achieved by controlling the valve to turn off a portion of the blaster nozzles 77. For some applications, bainite may only be needed in certain sections of the steel roll. Therefore, when a section of the steel sheet goes through the primary heat unit, only that desired portion of the steel sheet will be heated to a desired temperature and then immediately quenched to transform only that section of steel to bainite. A secondary heating unit 78 may optionally pre-heat the sheet of steel to a temperature in the range of about 1,400° F. to 1,800° F. before it enters into the primary heating unit 75.

Immediately thereafter, a quenching unit 79, which may preferably be a source of cooling water from about 32° F. to about 150° F., is directed at the sheet of steel 71 in a linear configuration to immediately cool the heated steel to room temperature. In order to vary the thickness, the second tensioning unit 76 may draw faster and tighter on the sheet of steel at a draw rate higher than the feed rate of the first tensioning unit 74. As the strip steel 71 is so hot in the heater, this intense stretching while "molten" will cause the strip to stretch and become thinner. The suitable distance between the primary heating unit 75 and the quenching unit 79 depends on the feed rate of the first tensioning unit 74 and the draw rate of the second tensioning unit 76, which as a whole is a determining factor in the varying thickness of the resulting material.

Figure 8:
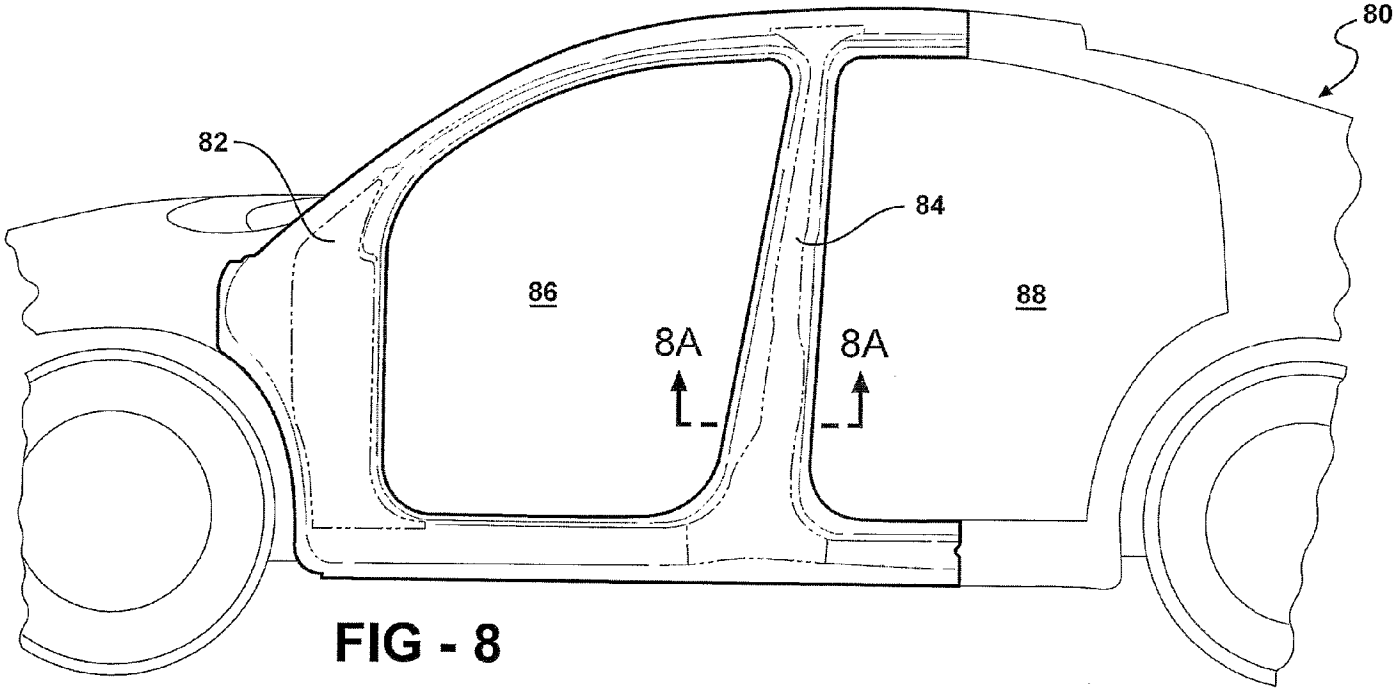
FIG. 8 shows a side elevation view of portions of bainite formed within an automobile panel utilizing the computer controlled micro-treating process in accordance with the present invention.

FIG. 8 shows a side elevation view of an automobile panel utilizing the micro-treating process in accordance with the present invention. An automobile panel, generally indicated by numeral 80, may be made of low carbon iron-based alloy that is partially transformed by the present invention to include various portions of the surface that have been transformed into bainite, martensite or a combination of them.

The method of making an automobile panel includes providing a micro-treated integral single layer steel sheet with bainite formed in portion thereof, and the sheet being made of varying thicknesses by heating up to a selected temperature, then immediately quenching to room temperature under various tensions. The process of micro-treating an integral single layer steel sheet is similar to the process of micro-treating an iron-based alloy as described above.

After providing a varying thickness steel sheet with portions of partially and/or fully transformed bainite, the method of making an automobile panel includes stamping the steel sheet to form an automobile panel 80 having a front pillar 82, a rear pillar 84, and a front door space 86 and a rear door space 88. The front pillar 82 and rear pillar 84 of the automobile panel have sufficient bainite transformed therein and may have the same thickness. A pattern of bainite increases the strength and formability of the front pillar 82 and the rear pillar 84 on the edges. The outer edges of the front pillar 82 and the rear pillar 84, being of bainite, are more formable and may be formed over itself, with a tough outer skin, and a center that is energy absorbing.

Figure 8A:
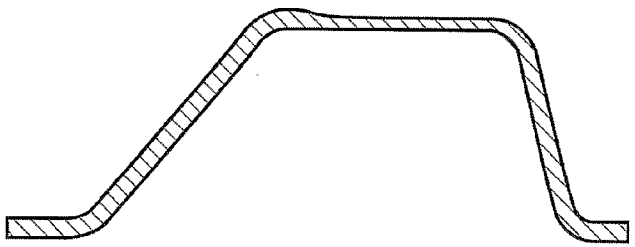
FIG. 8A shows a cross-section view of the automobile panel of FIG. 8.

FIG. 8A shows a cross-section view of the automobile panel of FIG. 8. The front pillar 82 and rear pillar 84 of the automobile panel having sufficient bainite transformed thereof may have the same thickness, which is thinner and lighter than the front door space 86 and the rear door space 88.

Another example includes the use of toughened hollow tubes in bainite for automobile rails under seats. Many other automotive components can be realized using the present invention. Laser welded blanks may also be used as panels inside doors, and the thickness can change due to the elongation achieved by the present process. Elongations of between about 2 and about 15 percent in length have been achieved by experimenting with the present invention, and further elongations are expected with more experimentation. Elongation may be achieved with drawing rollers, drag/drive capstans, and/or elongation drives, or any other suitable device for placing the iron-based alloy under tension.

In yet another particular aspect of the present invention, a one millimeter thick blank can have another one millimeter thick piece laser welded thereon, and the entire piece can be elongated under tension between two drawing rollers, which can provide a change in dimension along the length of the blank. When the steel is drawn between the two tensioning units (drawing rollers or other suitable method of stretching the steel which heating and cooling), and the heat is applied, the steel stretches a bit before being momentarily quenched. This elongation may find particular utility in automotive components where a piece of steel needs different dimensions along the length of the blank, in order to accommodate varying fixtures or properties.

The present invention alleviates the need for increased fuel costs to fire up a big furnace, as the heating is so localized. In addition, the advantages of long pieces not needing the normal corrective measures of mechanical straightening are of immense importance. The other disadvantages of furnace heat, including long cycle times from heating, and the use of vacuum or other non-oxidizing atmospheres to prevent surface oxidation, and the overall control of the heating because there is no longer a long "soak" time needed, are all advantages desired in the industry, as well.

The foregoing description of a preferred embodiment of the invention has been presented for purposes of illustration and description. Clearly, the number of applications for patterned steel and bainite are too numerous to mention here. The above description is not intended to be exhaustive or to limit the invention to the precise form disclosed. Obvious modifications or variations are possible in light of the above teachings with regards to the specific embodiments. The embodiment was chosen and described in order to best illustrate the principles of the invention and its practical applications to thereby enable one of ordinary skill in the art to best utilize the invention in varying embodiments and with varying modifications as are suited to the particular use contemplated.

INDUSTRIAL APPLICABILITY

The present invention finds industrial utility and applicability in the manufacture of iron-based alloys, including strengthened steel and in the manufacture of steel automotive components, including door panels and other automotive panels, as well as the manufacture of other iron-based alloy components such as flagpoles from tapered tubular steel and and/or anything made from steel that would require a strengthened part made from steel.

What is claimed is:

1. A method for micro-treating steel, said method comprising:

providing steel having a first micro-structure and a first thickness, said steel being capable of transforming to steel having a second micro-structure and a second thickness upon being rapidly heated to a selected temperature and then being immediately quenched;

feeding continuously the steel along a path of motion to a first tensioning unit at a feed rate;

rapidly heating, within 5 seconds, the steel at a heating unit to a selected temperature above the austenite conversion temperature, said selected temperature being at least 1832 ° F.;

wherein the heating is only performed until the selected temperature is reached and then the steel is substantially immediately quenched by quenching unit immediately adjacent the heating unit;

drawing the steel by a second tensioning unit at a draw rate of no more than 50 % higher than the feed rate to form a section of the steel having a second micro-structure and a second thickness.

2. The method of claim 1, wherein the steel contains carbon in a range of between 0.001 percent carbon by weight (wt %) to 4 percent carbon by weight (wt %).

3. The method of claim 1, wherein the first thickness is about 0.009 to about 0.250 inch.

4. The method of claim 3, wherein the first thickness is about 0.065 inch.

5. The method of claim 1, further including a pre-heating step to heat the steel to a temperature below the austenitic conversion temperature.

6. The method of claim 1, wherein the first and second tensioning units are selected from the group consisting of a pair of hydraulic pressure drawing rollers, drive capstans, and elongation drives.

7. The method of claim 1, wherein the feed rate is about 7 to 12 ipm.

8. The method of claim 7, wherein the feed rate is 0.75 ipm.

9. The method of claim 1, wherein the heating unit is selected from the group consisting of electric resistance, fluidized beds, electric furnaces, plasma furnaces, microwave ovens, open environment propane forges, gas fired unit, solid fuels, high temperature salt baths, induction heaters and torches.

10. The method of claim 1, wherein the heating unit transfers heat by a way selected from the group consisting of radiation, electrical resistance, conduction, convection, and induction.

11. The method of claim 1, wherein the heating unit includes propane torches.

12. The method of claim 1, wherein the selected temperature is at least approximately 1900 ° F.

13. The method of claim 1, wherein the selected temperature is between 1900 and 2350 ° F.

14. The method of claim 1, wherein the quenching unit adapts a quenching means selected from the group consisting of water, water-containing aqueous solutions, oil, molten salt, brine solutions, air, and powders.

15. The method of claim 1, wherein the draw rate is about 12 to 17 ipm.

16. The method of claim 1, wherein the second thickness is about 0.030 to 0.080 inch.

17. A method for micro-treating a strip of steel, said method comprising:

providing a strip of steel having a first micro-structure, a first thickness and a first width, the steel being capable of transforming to a steel having a second micro-structure, a second thickness and a second width upon being rapidly heated to a selected temperature and then being immediately quenched;

feeding continuously the strip steel along a path of motion to a first tensioning unit at a feed rate;

rapidly heating, within 5 seconds, the strip steel under tension at a heating unit to a selected temperature above the austenite conversion temperature, said selected temperature being at least 1832 ° F.;

wherein the heating is only performed until the selected temperature is reached and then the strip steel is substantially immediately quenched by a quenching unit immediately adjacent the heating unit;

drawing the strip steel by a second tensioning unit at a draw rate of no more than 50% higher than the feed rate to form a section of the strip steel having a second micro-structure, a second thickness and a second width.

18. The method of claim 17, wherein the strip of steel contains carbon in a range of between 0.001 percent carbon by weight (wt %) to 4 percent carbon by weight (wt %).

19. The method of claim 17, wherein the first thickness is about 0.009 to 0.250 inch.

20. The method of claim 19, wherein the first thickness is about 0.065 inch.

21. The method of claim 17, further including a pre-heating step to heat the strip steel to a temperature below the austenitic conversion temperature.

22. The method of claim 17, wherein the first width is about 2 to 5 inches.

23. The method of claim 17, wherein the first width is about 3 inches.

24. The method of claim 17, wherein the first and second tensioning units are selected from the group consisting of a pair of hydraulic pressure drawing rollers, drive capstans, and elongation drives.

25. The method of claim 17, wherein the feed rate is about 7 to 12 ipm.

26. The method of claim 25, wherein the feed rate is 10.75 ipm.

27. The method of claim 17, wherein the heating unit is selected from the group consisting of electric resistance, fluidized beds, electric furnaces, plasma furnaces, microwave ovens, induction heaters, open environment propane forges, gas fired unit, solid fuels, high temperature salt baths and torches.

28. The method of claim 17, wherein the heating unit transfers heat by a way selected from the group consisting of radiation, electrical resistance, conduction, convection, and induction.

29. The method of claim 17, wherein the heating unit includes propane torches.

30. The method of claim 17 wherein the selected temperature is at least approximately 1900 ° F.

31. The method of claim 30, wherein the selected temperature is between 1900 and 2350 ° F.

32. The method of claim 17, wherein the quenching unit adapts a cooling means selected from the group consisting of water, water-containing aqueous solutions, oil, molten salt, brine solutions, air, and powders.

33. The method of claim 17, wherein the draw rate is about 12 to 17 ipm.

* * * * *